United States Patent [19]

Strattan et al.

[11] Patent Number: 4,771,156

[45] Date of Patent: Sep. 13, 1988

[54] METHOD AND APPARATUS FOR HEATING AND DRYING MOIST ARTICLES

[75] Inventors: Robert D. Strattan; Mary E. O'Connor; James R. Sorem, Jr., all of Tulsa, Okla.

[73] Assignee: Micro Dry Incorporated, Tulsa County, Okla.

[21] Appl. No.: 920,605

[22] Filed: Oct. 20, 1986

[51] Int. Cl.[4] ..... H05B 6/64

[52] U.S. Cl. ..... 219/10.55 M; 219/10.55 A; 219/10.55 F; 34/1

[58] Field of Search ..... 219/10.55 M, 10.55 E, 219/10.55 O, 10.55 A, 10.55 F

[56] References Cited

U.S. PATENT DOCUMENTS

| | | | |
|---|---|---|---|
| 3,934,106 | 1/1976 | MacMaster et al. | 219/10.55 F |
| 4,006,338 | 2/1977 | Dehn | 219/10.55 F |
| 4,631,380 | 12/1986 | Tran | 219/10.55 M |

*Primary Examiner*—Robert S. Macon

*Attorney, Agent, or Firm*—Robert Salzman

[57] ABSTRACT

The invention relates to a microwave heating method and apparatus utilizing a multiplicity of microwave propagating sources positioned about a heating chamber. The microwave energies are optimized to provide a greater uniformity in the heating of articles disposed in the heating chamber, while preventing interference of the wave propagations. The microwave pulses are cross-polarized and time-multiplexed. Also, the focusing and spread angles are controlled.

25 Claims, 5 Drawing Sheets

2 PORTS, RECTANGULAR ADJACENT SIDES

2 PORTS, RECT., OPPOSITE SIDES

2 PORTS, CIRCULAR, ADJACENT QUADRANTS

3 PORTS, CIRC.,

3 PORTS, RECTANGULAR

4 PORTS, RECT.

6 PORTS, RECT.,

6 PORTS, CIRCULAR

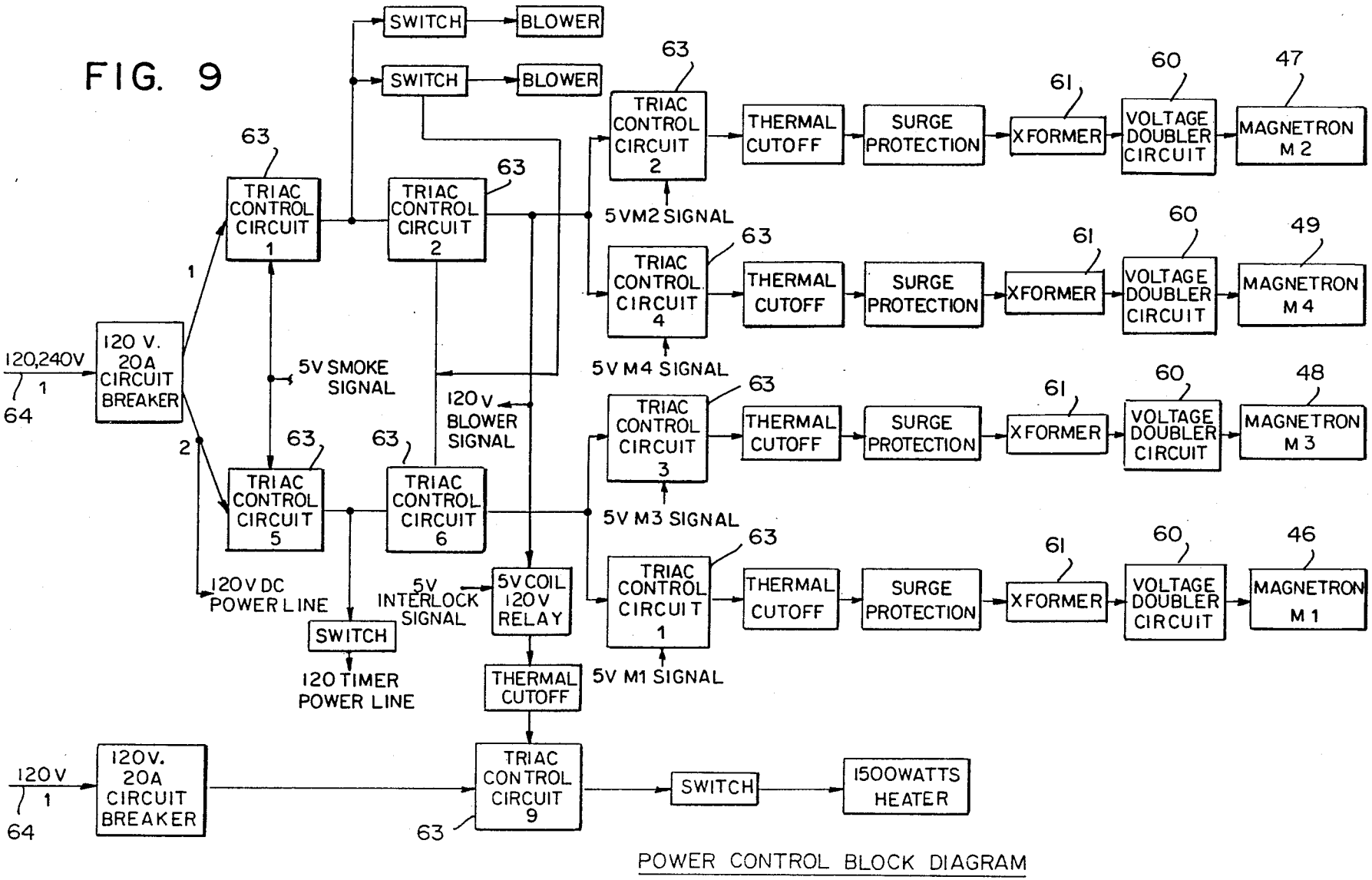
MAGNETRON M 2
MAGNETRON M 4
MAGNETRON M 3
MAGNETRON M 1
VOLTAGE DOUBLER CIRCUIT
XFORMER
SURGE PROTECTION
THERMAL CUTOFF
TRIAC CONTROL CIRCUIT 2
TRIAC CONTROL CIRCUIT 4
TRIAC CONTROL CIRCUIT 3
TRIAC CONTROL CIRCUIT 1
5V M2 SIGNAL
5V M4 SIGNAL
5V M3 SIGNAL
5V M1 SIGNAL
BLOWER
SWITCH
TRIAC CONTROL CIRCUIT 2
TRIAC CONTROL CIRCUIT 6
TRIAC CONTROL CIRCUIT 1
TRIAC CONTROL CIRCUIT 5
120 V BLOWER SIGNAL
5V SMOKE SIGNAL
5V COIL 120 V RELAY
5V INTERLOCK SIGNAL
THERMAL CUTOFF
TRIAC CONTROL CIRCUIT 9
SWITCH
120 TIMER POWER LINE
120 V DC POWER LINE
120 V. 20A CIRCUIT BREAKER
120,240V
120 V
1500WATTS HEATER
POWER CONTROL BLOCK DIAGRAM
FIG. 9

2 MICROWAVE SOURCES 48;49
S=30° ANGULAR SPREAD
1 REFLECTION

2 MICROWAVE SOURCES 48;49
S=30° ANGULAR SPREAD
2 REFLECTIONS

2 MICROWAVE SOURCES 48;49
S=40° ANGULAR SPREAD
1 REFLECTION

METHOD AND APPARATUS FOR HEATING AND DRYING MOIST ARTICLES

FIELD OF THE INVENTION

The invention relates to an improved method and apparatus for heating articles specifically fabric and clothing by microwave energy, and more particularly to a process and devices for improving the heating efficiency of a microwave generating system for fabrics by focusing, cross polarizing, angularly orienting and time-multiplexing the microwaves.

BACKGROUND OF THE INVENTION

The use of microwave energy to heat and cook comestibles has been an unqualified commercial success. Today, it is very hard to find an American home without a microwave oven.

As commonplace as the microwave oven has become, however, it is exceptionally surprising to observe the paucity of such heating devices for other household and industrial uses.

For example, as early as 1969, a method and apparatus was suggested for drying and sterilizing fabrics, as illustrated in U.S. Pat. No. 3,605,272, issued: Sept. 20, 1971.

The drying of wet fabrics should have become a commercial reality after fifteen years of research.

One of the drawbacks of perfecting a microwave clothes dryer has been the power requirements. Unlike a microwave oven, which requires a magnetron that generates 400 to 800 watts of microwave power, a typical clothes dryer needs a magnetron generating in excess of two kilowatts. A single magnetron generating this amount of power is very expensive.

Another possible problem with suggested microwave clothes dryer designs, is the inability to transfer and/or distribute the generated power uniformly to the wet fabric. Often hot spots develop in the fabric mass. Such hot spots can cause scorching of the fabric, and are a fire safety concern.

To the best of our knowledge, it never has been suggested that more than one magnetron be utilized to improve heating uniformity. Using two or more magnetrons would solve the first aforementioned problem, wherein several low cost magnetrons could efficiently replace one expensive unit.

However, a clothes dryer with two or more magnetrons would not necessarily be more efficient in the transfer or distribution of the microwave energies. Magnetrons whose generated waves share the same plane of propagation will interfere with each other. Also, unabsorbed power that reflects off the heating chamber walls can enter the wave guide of an adjacent magnetron through its antenna and alter its operation and efficiency.

BRIEF SUMMARY OF THE INVENTION

The invention features a method and apparatus for improving the uniformity of heating an article or articles being heated by microwaves within a heating chamber. The microwaves are directed into the heating chamber in a substantially non-interfering manner from at least two positions disposed about the heating chamber. Anywhere from between two and six magnetrons can be used for this purpose. The microwaves from at least two positions are cross-polarized or oriented perpendicularly with respect to each other to prevent or minimize interference between them.

The possibility of interference is further reduced by independently time-multiplexing the generation of the microwaves at each position. Thus, simultaneous heating from two or more generating sources will not occur.

The articles are additionally heated in a uniform manner by angularly focusing the directed microwaves, i.e. the directed angle between certain ones of the microwave generators is less than 90 degrees. The angular focusing of the magnetrons can be accomplished by shaping the heating chamber end plates in a frustroconical or pyramidal fashion, i.e. the walls defining a portion of the heating chamber are obliquely angled to form conical or pyramidal shapes. The magnetrons positioned upon these obliquely angled chamber portions will, as a consequence, direct the generated microwaves into the chamber at an angle of less than 90 degrees between them.

The uniformity of the heating within the chamber is also controlled by varying the angular spread of the microwaves. The spread of the microwaves at each magnetron is controlled between 30 and 40 degrees.

It is an object of this invention to provide an improved method and apparatus for heating an article or articles by microwave energy utilizing multiple microwave sources.

It is another object of the invention to provide a method and apparatus for heating an article or articles by multiple magnetrons in a more uniform manner, and generally without causing interference between the generated waves or the operation of the magnetrons.

It is a further object of this invention to provide a more efficient and efficacious method and apparatus for the drying of wet fabric and clothing articles by microwave energy.

These and other objects of the invention will become more apparent and will be better understood by subsequent reference to the detailed description considered in conjunction with the accompanying drawings.

BRIEF DESCRIPTION OF THE DRAWINGS

FIG. 9 is a schematic block diagram of a typical circuit for controlling and energizing a microwave heating chamber having four magnetrons;

FIG. 10*aa* depicts the diagrammatic cross-sectional view of FIG. 10*a*, with a double reflection of the microwave propagation;

DETAILED DESCRIPTION OF THE INVENTION

Generally speaking, the invention pertains to a method and apparatus for heating one or more articles, particularly moist fabrics, in a microwave heating chamber. The invention utilizes a plurality of microwave sources in order to more uniformly distribute and propagate the microwave energies. The chamber and microwave port configurations are designed to prevent, or at least minimize, interference between the microwaves and microwave source operation, while more uniformly focusing and spreading the microwave energy. The invention accomplishes the above objectives by providing at least one or all of the following techniques:

a. focusing the microwave energy into the heating chamber.

b. cross-polarizing the multiple source microwave propagations.

c. angularly orienting or spreading the microwave propagations to densify the energy propagated into the heated articles disposed in the chamber.

d. time-multiplexing, or independently pulsing each microwave generator to prevent operational interference therebetween.

Figure 1A:
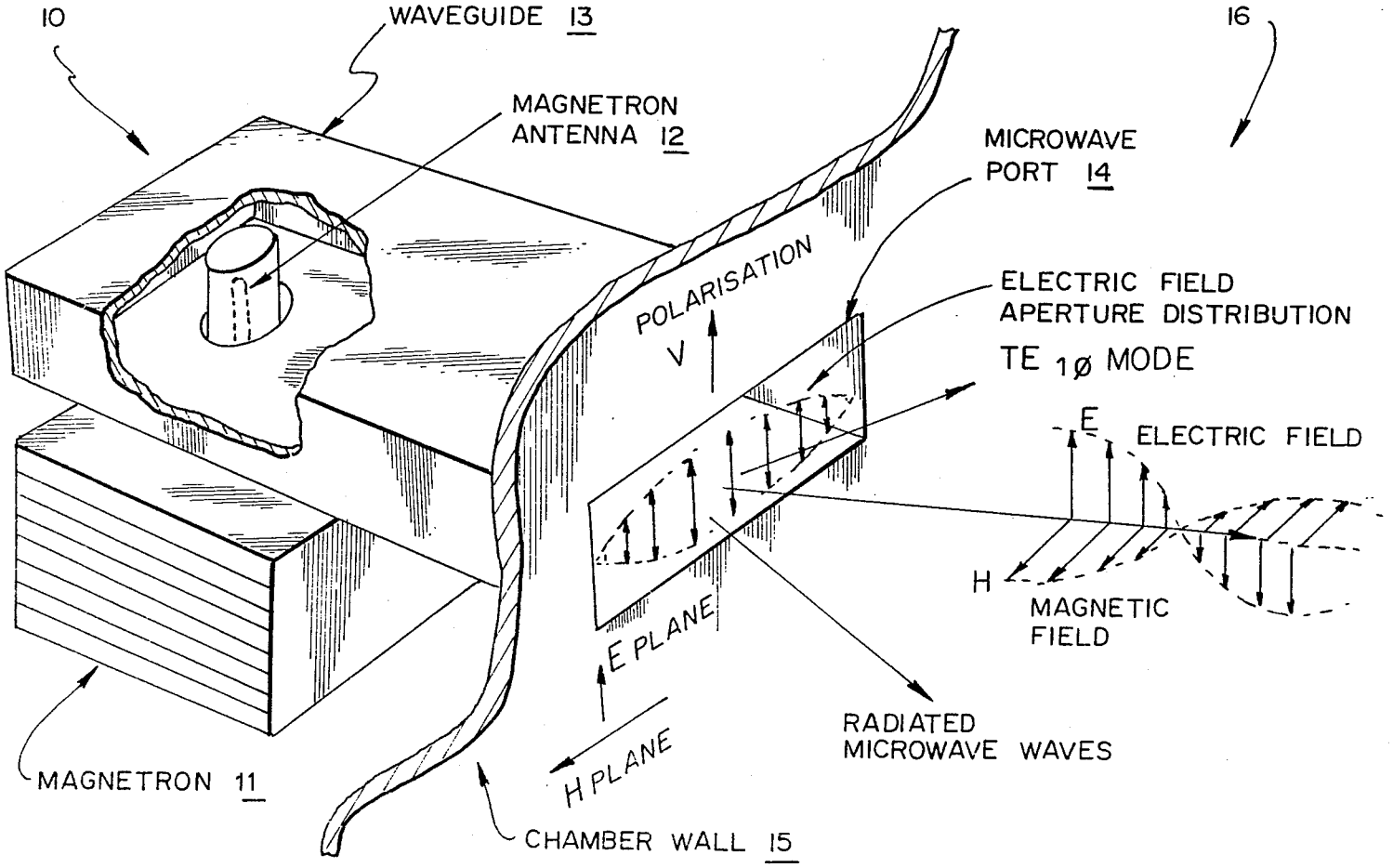
FIG. 1*a* is a perspective diagrammatic view of a microwave source illustrating the field polarization of the microwaves.

Now referring to FIG. 1*a*, a schematic of one of several typical microwave sources 10, such as a magnetron 11 antenna 12 and wave guide 13 is shown propagating the generated microwaves through a port 14 disposed in a wall 15 of a heating chamber cavity defined by arrow 16. The moist fabrics or clothing articles (not shown) are heated and tumbled within the heating chamber cavity 16, in order to remove the moisture and dry the fabrics.

The microwave power injected into the chamber interacts with the water molecules in the wet fabric. The microwave power is converted to heat, providing the heat of vaporization required for the transition of the water from liquid to gas. Once in the gaseous state, the water vapor is transported out of the chamber by an air stream (not shown). Pre-heating the air stream with waste heat from the magnetrons improves the efficiency of the evaporation process, as does the tumbling action.

The microwaves will heat the fabric in the chamber in proportion to the mass of the material and electromagnetic loss factor. Non-uniform heating of the fabric can cause hot spots, with the possibility of scorching and ignition of the fabric. Thus, the invention has as one of its purposes to more uniformly inject and distribute the microwave energy into the chamber cavity 16.

The location and orientation of the multiple ports 14 and microwave sources 10 feeding power into the drying chamber cavity 16 must be properly chosen to provide uniform and efficient power transfer to the wet fabric. The use of multiple sources 10 provides a uniform density and distribution of power. Additionally, such multiple microwave sources can utilize readily-available, low-cost magnetron tubes and power supplies produced for microwave ovens. It is desirable to feed the microwave power into the chamber cavity 16 from more than one port 14 to assure a uniform heating rate throughout the volume of the clothes to be dried. Multiple ports 14 facilitate the use of multiple magnetrons 11 or other microwave generating devices. Using only one source to provide the necessary two or more kilowatts of microwave power would require expensive industrial magnetron tubes or other microwave sources not readily available from suppliers. Magnetrons manufactured for microwave ovens typically produce 400 to 800 watts of microwave power each. A typical domestic clothes dryer would require 2 to 6 of these magnetron tubes.

In addition to locating the multiple ports 14 on chamber in walls 15 in positions that ensure uniform illumination of the wet fabric load, the polarization orientation of the microwave ports 14 is important. The polarization of the microwave radiation must be crossed, or oriented perpendicularly, between ports that are co-aligned. This cross-polarizing minimizes the coupling between ports 14 to ensure more efficient operation and generation of microwave power over a wide range of loading conditions.

As shown in FIG. 1*a* a typical microwave power source 10 has port 14 opening into the chamber 16, to provide the resulting electromagnetic fields. The polarization is designated as the spacial orientation of the electric field directions with the E-plane vertical. The magnetron 11 couples the microwave power into the waveguide 13 through an antenna 12 that protrudes through the broad wall, or H-plane, of the waveguide 13. The E- and H-plane refer to the forced spacial orientations of the electric (E) and magnetic (H) field components of the $TE_{10}$ electromagnetic wave propagation mode that exists in the rectangular waveguide 13. A WR-284 size waveguide operating at 2.45 Hz ensures that only the $TE_{10}$ mode will transport power to the port 14. The electric field will be oriented in a plane parallel to the magnetron antenna and perpendicular to the broad wall, or in the E-plane. The E-plane is vertical in the illustration of FIG. 1*a*. For the purposes of this description this is a vertical polarization orientation. Obviously, other orientations are possible within the scope and limits of the invention.

While the electric field varies in intensity across the aperture of port 14 into the chamber cavity 16, its polarization remains vertical. The resulting radiated field will have the same field orientation or polarization. The radiated waves will propagate outwardly in all directions in the hemisphere, but will have the greatest intensity along the axis of the waveguide and perpendicular to the chamber wall 15.

Most of the radiated microwave power will be absorbed by the clothes in the central part of the chamber cavity 16. The unabsorbed power will reflect from the walls 15 of the chamber or be coupled into the ports 14 of the other microwave sources 10. The unabsorbed power that enters the waveguide 13 can interact with the magnetron 11 through its antenna 12 and alter its electromagnetic operating environment and efficiency. The orientation of the ports 14 such that those with the largest potential for coupling have their polarizations crossed, minimizes the possibility of power from one source interfering with the operation of another source. Various embodiments of the invention are shown in FIGS. 1 through 8. Polarization is indicated as H (horizontal) and V (vertical).

Figure 1:
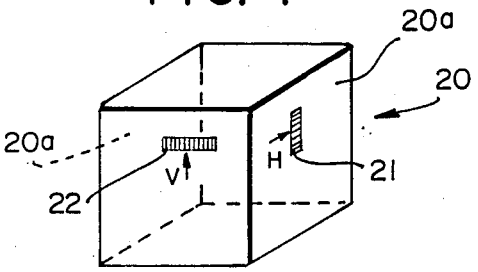
FIGS. 1 through 8 are perspective, schematic views of eight embodiments of the invention, illustrating various heating chamber configurations, each of which depict different magnetron port placements about the respective chambers.

Referring to the various embodiments of FIGS. 1 through 8, like elements or components will have the same designation. In FIG. 1, a rectangular heating chamber 20 has two microwave ports 21 and 22, respectively. They are located on adjacent sides of the rectangular chamber 20 to minimize directional coupling and the ports 21 and 22 are cross-polarized to further reduce coupling between the microwave fields.

Figure 2:
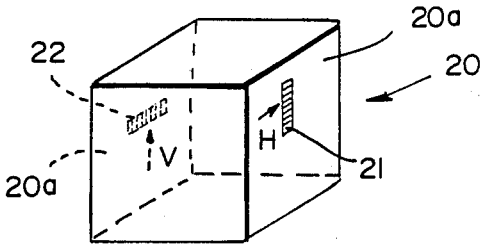

FIG. 2 shows a double port rectangular chamber 20, similar to FIG. 1, where the ports 21 and 22, respectively, are on opposite sides of chamber 20 and the reduction of port to port coupling depends entirely upon the cross-polarization of the ports 21 and 22.

Figure 3:
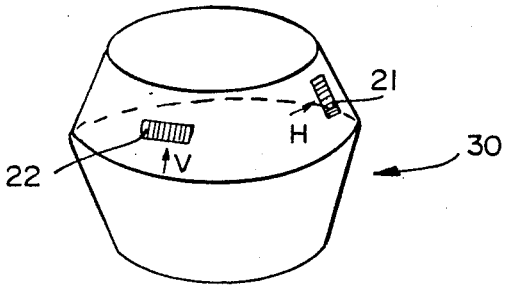

FIG. 3 shows the two ports 21 and 22 in adjacent quadrants, with a cross-polarized port arrangement wherein ports 21 and 22 are disposed about a frustro-conical circular chamber 30.

Figure 4:
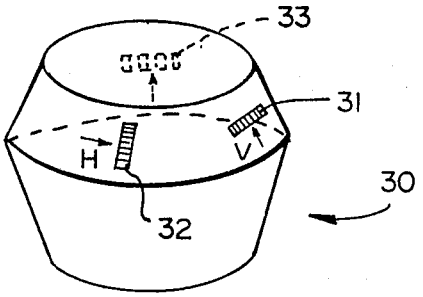

FIG. 4 shows three ports, 31, 32 and 33, respectively, arranged about the circular frustro-conical chamber 30. The ports 31, 32 and 33 are cross-polarized to decouple the diametrically opposed ports.

Figure 5:
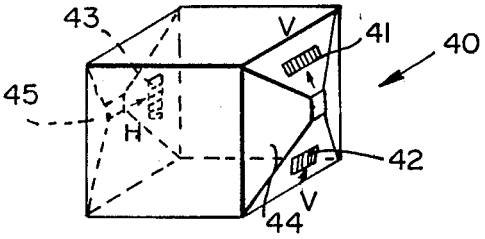
Figure 6:
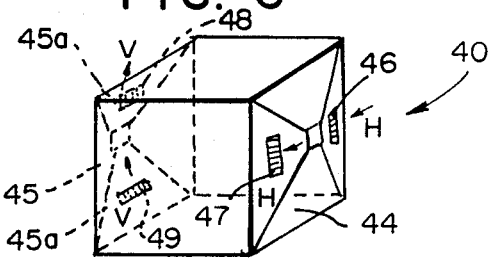

FIG. 5 shows three ports, 41, 42 and 43, respectively, disposed about rectangular chamber 40. Chamber 40 has pyramidal ends 44 and 45 respectively. The ports 41 and 42 on end 44 are cross-polarized with port 43 on end 45 to minimize coupling. The pyramidal ends 44 and 45 aid in redirecting the microwave reflections so that coupling between co-polarized ports 41 and 42 on the same end 44 is minimized. The same concept as shown in FIG. 5 is extended in FIGS. 6 and 7, to accommodate 4 and 6 ports, respectively. The arrangement shown in FIG. 6 is the preferred embodiment. This arrangement is also obviously adaptable to 5, 7 and 8 ports.

The chamber 40 in FIG. 6 has similar pyramidal ends 44 and 45 to focus or angle the pairs of cross-polarized ports 46 and 47; and ports 48 and 49. This focusing which redirects the reflections of the microwaves will be better explained hereinafter, with reference to FIGS. 10*a*, 10*aa* and 10*b*.

Figure 7:
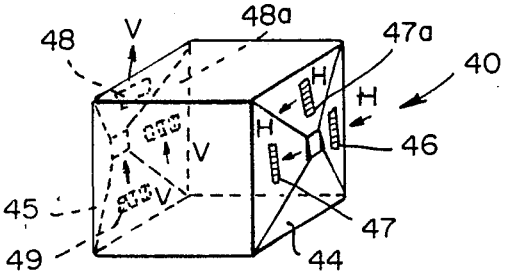

FIG. 7 depicts chamber 40 having a group of 3 ports 46, 47 and 47*a* on pyramidal end 44 which are cross-polarized with a group of 3 ports 48, 48*a* and 49 disposed upon pyramidal end 45.

Figure 8:
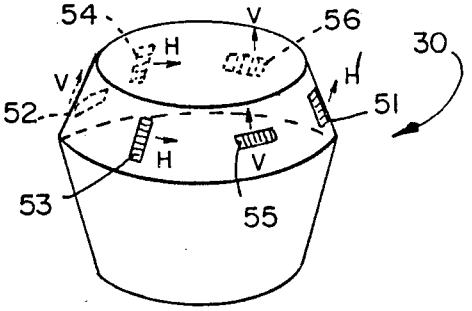

A six port circular frustro-conical arrangement is shown in FIG. 8. The diametrically opposite ports 51 and 52 disposed on chamber 30 are cross-polarized, as are the adjacent pairs of ports 53 and 54; 55 and 56. This minimizes the port to port coupling. Similar arrangements can be developed for other chamber shapes and number of ports following these basic guidelines, in accordance with the teachings of this invention.

Referring now to FIG. 9, a power circuit is shown for a chamber configuration having four magnetrons, such as the chamber 40 of FIG. 6.

Additional isolation of the coupling between magnetron sources 46; 47 and 48; 49 is provided by the time multiplexing of the pulsed microwave power output of the magnetrons. A voltage doubler circuit 60 for each magnetron is used to provide the high voltage electrical power to the magnetrons from a 60 Hz power line 64. The nature of this circuit and the magnetrons is that a pulse or burst of microwave power is produced for a few milliseconds of the 1/60 second period of the input power waveform. By using the two opposing phases of the 120/240 volt power source, or by alternating the polarities of transformers 61, the time periods of microwave power production of adjacent magnetrons can be offset so that simultaneous power production does not occur. This further reduces the coupling effects between multiple sources.

The flow of power from the 120/240 volt 60 Hz supply line 64 through the various control circuits to the four magnetrons 46; 47; 48 and 49, the blower and heater controls, and various smoke, heat and humidity sensors, is shown. The triac circuits 63 provide on or off switching of the a.c. power based upon proper control signal status. The power is fed to transformers 61 and diode/capacitor voltage doubler circuits 60 that provide a pulse of high voltage direct current power to the magnetrons 46; 47; 48 and 49 producing a pulse of microwave power.

Humidity and temperature sensor circuit outputs are compared to reference thresholds. The logical outputs of these threshold comparisons are combined, along with the conditions of other inputs such as door-closed interlocks on chamber 40 and a timer clock. If all conditions are met, including other controls such as smoke free air stream and blower-on condition, power is applied to the magnetrons. If all conditions are not met the magnetron power will be interrupted. Some examples of interrupt conditions include low humidity, high temperature, door open, etc. A removable tumbler interrupt signal, if the tumbler is not in place, may also be included.

Figure 11:
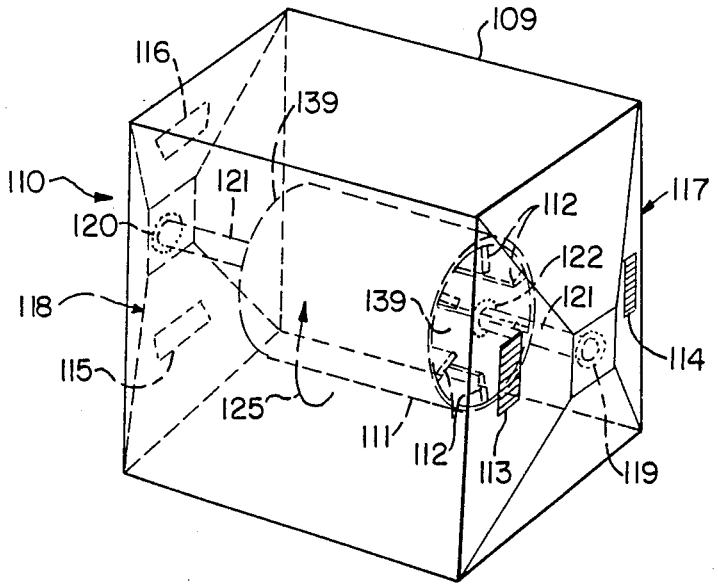
FIG. 11 is a perspective schematic view of the heating chamber and tumbler drum arrangement.

Optimum design would probably be a cylindrical container with 3 to 5 ribs. In the current design, maximization of air flow through the tumbler is attempted by: (1) forcing the air into one end of the tumbler with a deflector, and (2) not providing openings in the tumbler other than at the two ends. The inlet and outlet ducts were placed on opposite ends of the container to optimize cross-flow air. Referring to FIG. 11, a moist fabric microwave heating and drying apparatus 110 of this invention comprises heating chamber 109, similar to the embodiment shown in FIG. 6. Chamber 109 is illustrated in schematic view. An airflow system shown in sectional view of FIG. 12, will be understood to be part of the entire apparatus 110.

Moist fabrics (not shown) are loaded into a portable, rotatable tumbling drum 111, which has internal vanes 112 for tumbling the moist fabric as the drum 111 is caused to rotate (arrow 125). The tumbling drum 111 is microwave permeable, being made of a plastic such as Lexan, so that moist fabrics disposed within the drum can be irradiated. Microwaves are directed at drum 111 from magnetron fed waveguides 113, 114, 115 and 116, respectively disposed about heating chamber 109 as illustrated.

The chamber 109 can be of a generally similar shape as that depicted in FIG. 6, with pyrimidal-shaped side walls 117 and 118, respectively.

At the apex of walls 117 and 118, are respective internal bearings 119 and 120, for rotatively supporting drum shaft 121 which is fixedly attached to drum 111 at the distal ends 122 and 123, respectively.

A motor 124 rotatively drives drum shaft 121, thus causing drum 111 to rotate (arrow 125) within end bearings 119 and 120.

The end walls 117 and 118 are each pyrimidal-shaped to allow the waveguides to project the microwaves into the center of the chamber, as described in more detail with respect to FIGS. 10*a*, 10*aa* and 10*b* hereinafter.

Figure 12:
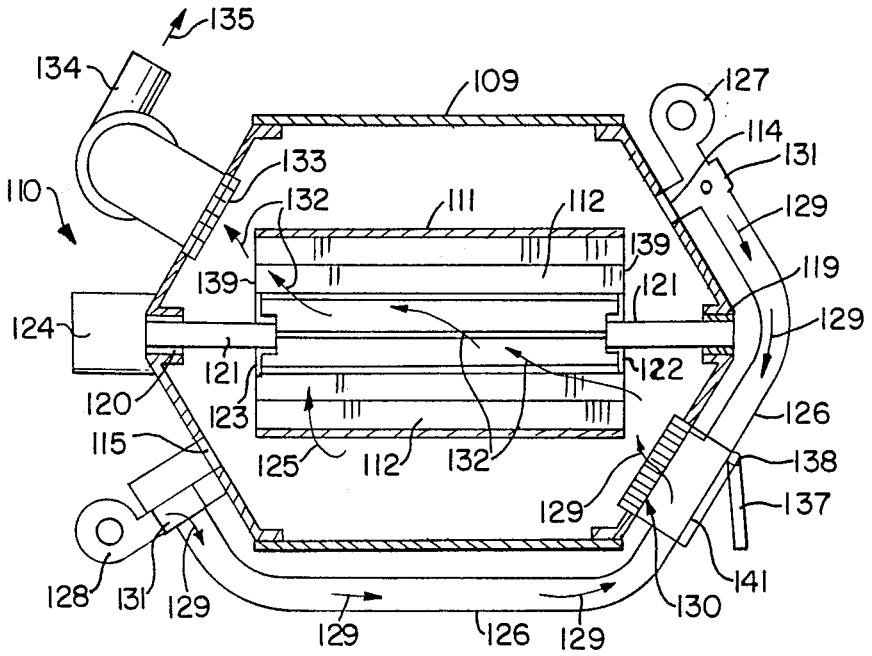
FIG. 12 is a sectional view of the chamber of FIG. 11, depicting the airflow system for carrying away moisture during the drying cycle.

There are two air ducts 126, only one of which is shown in the sectional view of FIG. 12 for the sake of brevity. Each duct 126 has two squirrel-cage blowers 127 and 128, respectively disposed therein as shown. Each of the blowers 127 and 128 feeds air (arrows 129) through duct 126 towards, and into, a commom chamber inlet 130. Each blower 127 and 128 cools a magnetron 131 disposed adjacent its respective waveguide. There are a total of four magnetrons 131, each of which operates a 2,450 MHz with 700 Watts power. There are two magnetrons 131 in each air duct 126.

During the drying portion of the microwave heating cycle, air enters inlet 130 of chamber 109 from the two air ducts 126, and is directed across the heating chamber 109 (arrows 132) towards chamber outlet 133. The airflow 132 passes through tumbler drum 111, as aforementioned, as it is caused to rotate and tumble the moist fabric (arrow 125).

Evaporated moisture resulting from the microwave heating of the moist fabric is then carried away by airflow 132, and exits chamber 109 at outlet 133. An exhaust duct 134 disposes of the moist air, as shown by arrow 135.

In the drying cycle, gate 137 is kept shut about hinge 138, so that all of the airflow 129 is directed into chamber 109 via inlet 130.

Airflow 132 passes through drum 111 by means of perforations (not shown) on distal ends 139 thereof. The airflow 129 is used to also cool the magnetrons and supply heated air into the chamber 109.

The decision regarding the shape of the chamber 40 as shown in FIG. 6, was made following the decision to use between 2 and 6 magnetrons. A software program operating on a PC computer was written to provide a visual model of chamber 40 and to simulate the reflection of microwave radiation in the container. The program allowed for variation in the shape of chamber 40, the angular spread of the microwave signal, and the number of reflections. This program presented a strictly two dimensional model of the contained area. The reflection patterns as shown in FIGS. 10*a;* 10*aa* and 10*b* were compared with regard to apparent production of hot and cold spots in various configurations. The chamber 40 was fabricated with flat plate to increase angular reflections of the microwaves. Instead of placing flat end caps 20*a* on chamber 20 shown in FIGS. 1 and 2, four sided pyramids 44 and 45 were used as shown for chamber 40 of FIGS. 5 and 6. The pyramidal shape when combined with the cross-polarization of the magnetrons on opposite ends reduces likelihood of magnetron coupling.

Figure 10A:
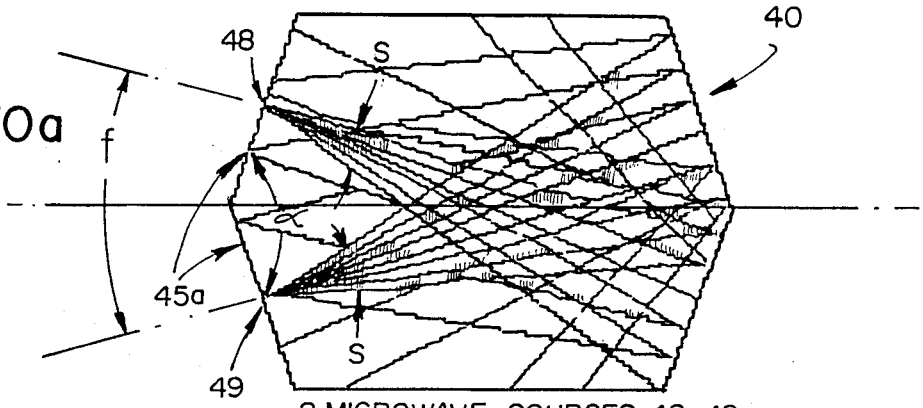
FIG. 10*a* is a diagrammatic cross-sectional view of a single reflection of a microwave propagation for the heating chamber configuration and port placement embodiment shown in FIG. 6, depicting an angular focusing of both microwave fields of less than 90 degrees therebetween, and an angular spread of 30 degrees for each wave propagation.
Figure 10A:
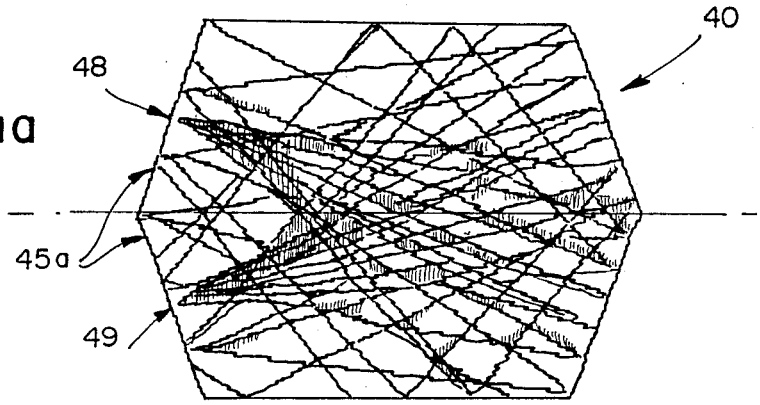
Figure 10B:
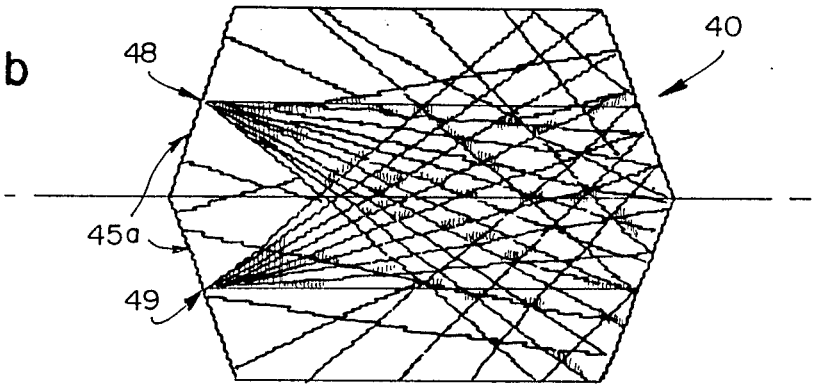
FIG. 10*b* illustrates the diagrammatic, cross-sectional view of FIG. 10*a*, with an angular spread of 40 degrees for each wave propagation.

FIG. 10*a* depicts magnetrons 48 and 49 propagating microwaves into chamber 40 of FIG. 6 at an angle "f" of less than 90 degrees between them. The angle "f" is a consequence of the pyramidal angle "$\alpha$" between the end plates 45*a*. The angle "f" of the microwave pulses illustrates how the microwave energy can be focused into the center of the chamber 40 where the tumbling fabrics are more likely to absorb the microwave energy. The angular spread "s" of 30 degrees as shown in FIGS. 10*a* and 10*aa;* or 40 degrees as shown in FIG. 10*b*, illustrates that the densification and the reflection of the microwaves can be controlled, as well as the focusing angle "f", in order to provide optimum heating conditions.

Having thus described the invention, with emphasis on fulfilling the objectives previously set forth, it is the intention to protect this invention by Letters Patent as presented by the subsequently appended claims.

What is claimed is:

1. A method of improving the uniformity of heating and drying of an article or articles of moist fabric being heated and dried by microwaves within a heating and drying chamber having a plurality of magnetrons disposed about the chamber in at least two substantially oppositely planar positions for generating non-interfering waves of energy, a tumbler for tumbling said moist fabric, said tumbler disposed within said heating and drying chamber, and means for providing a flow of air through said tumbler for carrying away the moisture, said method comprising the steps of generating and directing microwaves into said heating and drying chamber from said at least two magnetrons disposed in said substantially oppositely planar positions about said heating and drying chamber, said microwaves from said at least two positions being cross-polarized with respect to each other for minimizing interference therebetween, tumbling said fabric article or articles in conjunction with said microwave generation, and causing a flow of air through said tumbler for drying said fabric article or articles.

2. The method of claim 1, wherein said directed microwaves from said at least two positions are generated independently by time-multiplexing, whereby simultaneous heating from said at least two positions does not occur.

3. The method of claim 2, wherein said microwaves are directed at said article or articles from two positions, with an angular focus between said two positions of less than 90 degrees.

4. The method of claim 1, wherein said microwaves are directed at said article or articles from two positions with an angular focus between said two positions of less than 90 degrees.

5. The method of claim 1, wherein each microwave position has an angular spread of microwaves of approximately between 30 and 40 degrees as directed into said heating chamber.

6. The method of claim 1, wherein said microwave position has an angular spread of microwaves of approximately between 30 and 40 degrees as directed into said heating chamber.

7. The method of claim 2, wherein each microwave position has an angular spread of microwaves of approximately between 30 and 40 degrees as directed into said heating chamber.

8. The method of claim 3, wherein each microwave position has an angular spread of microwaves of approximately between 30 and 40 degrees as directed into said heating chamber.

9. An apparatus for substantially uniformly heating and drying an article or articles of moist fabric by microwaves, comprising: a heating and drying chamber having at least two microwave generating magnetrons for generating microwaves from at least two substantially oppositely planar positions disposed about said chamber, said magnetrons being positioned such that said microwaves are cross-polarized with respect to each other when directed into said heating and drying chamber from said at least two substantially oppositely planar positions for minimizing interference therebetween, a tumbler disposed within said heating and drying chamber for containing and tumbling said moist fabric article or articles, and means for forcing air through said tumbler for the purpose of carrying away the moisture.

10. The apparatus of claim 9, wherein there are between two and six generating means for generating microwaves disposed about said heating chamber.

11. The apparatus of claim 9, further comprising circuit means operatively connected to said generating means for time multiplexing said generating means, such that each generating means is powered independently whereby simultaneous heating from more than one generating means does not occur.

12. The apparatus of claim 9, wherein certain ones of said generating means are angularly arranged about said heating chamber such that the microwaves are focused into said heating chamber with an angular focus of less than 90 degrees between said positions of said generating means.

13. The apparatus of claim 12, wherein each generating means generates microwaves having an angular spread of approximately between 30 and 40 degrees as directed into said heating chamber.

14. The apparatus of claim 9, wherein each generating means generates microwaves having an angular spread of approximately between 30 and 40 degrees as directed into said heating chamber.

15. The apparatus of claim 9, wherein said heating chamber is defined in a portion thereof by walls that form a conical-type configuration.

16. The apparatus of claim 9, wherein said heating chamber is defined in a portion thereof by walls that form a substantially pyramidal shape.

17. The apparatus of claim 11, wherein said circuit means includes at least one voltage doubler circuit.

18. The apparatus of claim 9, wherein said generating includes a plurality of magnetrons each having a power output generally not exceeding 800 watts.

19. A method of improving the uniformity of heating and drying an article or articles of moist fabric in a chamber using microwaves to heat and dry the moist fabric article or articles, comprising the steps of: generating microwaves and directing them into said heating and drying chamber, tumbling said moist fabric article or articles in conjunction with said microwave generation, said microwave generation being accomplished by magnetrons disposed about said chamber at substantially oppositely planar positions, said microwaves being independently generated by means of time-multiplexing, and passing air through said moist fabric article or articles for carrying away moisture.

20. An apparatus for substantially uniformly heating and drying an article or articles of moist fabric by microwaves, comprising: a heating and drying chamber having at least two microwave generating magnetrons for generating microwaves independently of each other, and means for time-multiplexing said magnetrons, said magnetrons being disposed about said chamber at substantially oppositely planar positions, means for tumbling said moist fabric article or articles in conjunction with the generation of said microwaves, and means for passing air through said means for tumbling said moist fabric article or articles for carrying away moisture therefrom.

21. The apparatus of claim 9, wherein said tumbler is removable from said chamber.

22. The apparatus of claim 21, further comprising a control for interrupting magnetron power in response to a condition indicative of said tumbler not being in place within said heating and drying chamber.

23. The apparatus of claim 21, wherein said tumbler is substantially cylindrical in shape.

24. The apparatus of claim 23, wherein said tumbler comprises a container having from 3 to 5 ribs.

25. The apparatus of claim 23, wherein said tumbler has openings only at its cylindrical ends.

* * * * *